United States Patent [19]

Scalzi

[11] Patent Number: 4,813,180

[45] Date of Patent: Mar. 21, 1989

[54] DOUBLE-HUNG WINDOW PIVOT

[75] Inventor: John Scalzi, Lexington, Mass.

[73] Assignee: Harvey Industries, Manchester, N.H.

[21] Appl. No.: 71,490

[22] Filed: Jul. 9, 1987

[51] Int. Cl.[4] ..... E05D 15/22

[52] U.S. Cl. ..... 49/161; 49/176; 49/181

[58] Field of Search ..... 49/161, 176, 181

[56] References Cited

U.S. PATENT DOCUMENTS

| | | | |
|---|---|---|---|
| 4,068,406 | 1/1978 | Wood | 49/181 |
| 4,364,199 | 12/1982 | Johnson et al. | 49/181 |
| 4,590,708 | 5/1986 | Campodonico | 49/181 |
| 4,610,108 | 9/1986 | Marshik | 49/181 |
| 4,718,194 | 1/1988 | Fitzgibbon et al. | 49/181 |

*Primary Examiner*—Philip C. Kannan

*Attorney, Agent, or Firm*—Davis, Bujold & Streck

[57] ABSTRACT

A double-hung window pivot which eliminates the need for banding of the window during shipment and installation. The pivot includes a sliding member which has a bore perpendicular to a front surface thereof and a pivot button with a slot captively held in the bore which includes a retaining member adjacent a bottom surface thereof. A pivot bar is attached to the window sash and includes a projection sized to fit into the slot and has a slotted arrangement positioned to engage the retaining member. The projection is insertable into and removable from the slot only when the window sash is oriented with respect to the window frame in a position not used for vertical sliding movement or for pivoted cleaning of the window sash whereby the pivot bar and the pivot button are non-releasably connected together during normal shipment, installation and use of a window sash and frame employing the window pivot.

17 Claims, 3 Drawing Sheets

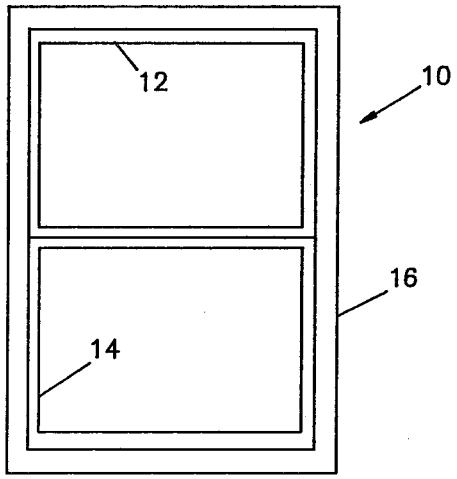
FIG. 1
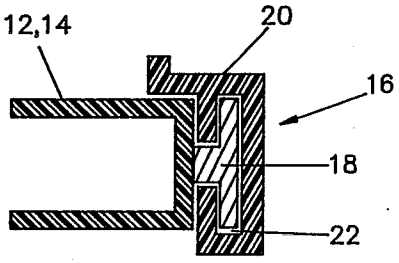
PRIOR ART
FIG. 2
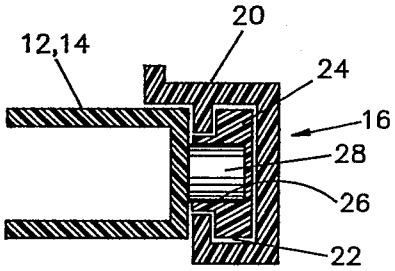
PRIOR ART
FIG. 3
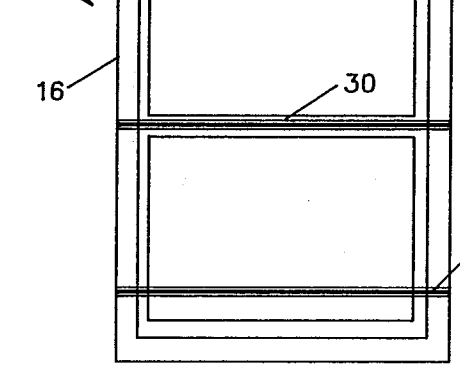
PRIOR ART
FIG. 4
FIG. 5

DOUBLE-HUNG WINDOW PIVOT

BACKGROUND OF THE INVENTION

This invention relates to pivots for double-hung windows and, more particularly, to a double-hung window pivot for slidably and pivotally mounting a window sash to the side member of a window frame having a vertical guide track therein comprising, a sliding member disposed within the guide track for sliding motion, the sliding member having a bore therein perpendicular to a front surface thereof facing a side edge of the window sash; a pivot button captively held in the bore for rotational movement, the pivot button including a first portion of connecting means for connecting a bar to the pivot button; and, a pivot bar attached to the window sash and extending outward horizontally therefrom towards the guide track, the pivot bar including a mating second portion of the connecting means for connecting a bar to the pivot button, the connecting means being connectable and disconnectable only when the window sash is oriented with respect to the window frame in a position not used for vertical sliding movement or for pivoted cleaning of the window sash whereby the pivot bar and the pivot button are non-releasably connected together during normal shipment, installation and use of a window sash and frame employing the window pivot.

A typical double-hung window as wherein the present invention is applicable is shown in simplified form in FIG. 1 wherein it is generally indicated as 10. Window 10 comprised an upper sash 12 and a lower sash 14 slidable mounted in a frame 16. While older windows were constructed of wooden parts assembled to create the elements of the frame and sashes, plastic and extrusions have become employed in modern high quality windows. By employing construction as depicted in FIG. 2, the plastic windows make it possible to pivot the window sashes 12, 14, for example, in the frame 16 for cleaning both sides of the window panes from inside the house. This is accomplished by employing a metal pivot member 18 projecting from the side frame 20 and riding in a guide track 22 formed into the window frame 16. By making the pivot member 18 T-shaped, the window sash can be inserted into the frame by orienting it 90° to it up and down position so as to fit the T-shape into the guide track 22 where it is then made captive by rotating the sash 90° back to its ordinary working position. Examples of prior art related to this type of construction can be seen with reference to U.S. Pat. No. 4,581,850 of Simpson.

A prior art improvement to the above-described basic pivot mechanism involved inplementing a brake as part of the pivot so that the sash would be held in place when pivoted for cleaning. Such a prior art pivot is shown in simplified form in FIG. 3. A plastic guide member 24 is assembled into the guide track 22. The guide member 24 has a bore 26 therein adapted to receive a metal pivot button 28 attached to the side frame 20 and projecting outward therefrom. The pivot button 28 includes a camming surface (not shown) which activates a brake or lock (also not shown) when the window sash is pivoted. The sash is assembled to the window frame by bowing the window frame side pieces outward sufficiently for the button 28 to clear and be positioned to enter the bore 26 when the side pieces are released. While the prior art window pivot of FIG. 3 works for its intended purpose, it creates the problem shown in FIG. 4; that is, if the frame side pieces are bowed outward during shipment or installation of the assembled window into a building, the sashes can come out and be broken. Thus, it is typical to using banding tape 30 in the manner depicted in FIG. 5 to hold the assembled window 10 together during shipment and installation. This, of course, adds to the cost of manufacture since additional labor and materials are required to apply the banding tape 30.

Wherefore, it is the object of the present invention to provide a window pivot for use in plastic double-hung windows which is easy to assemble, economical to produce, incorporates a brake or lock therein, and which will not come apart after assembly so that banding of the window during shipment and assembly is not required.

Other objects and benefits of the present invention will become apparent from the description contained hereinafter taken in conjunction with the drawing figures which accompany it.

SUMMARY

The foregoing objects have been attained by the double-hung window pivot of the present invention for slidably and pivotally mounting a window sash to the side member of a window frame having a vertical guide track therein comprising, a sliding member disposed within the guide track for sliding motion, the sliding member having a bore therein perpendicular to a front surface thereof facing a side edge of the window sash; a pivot button captively held in the bore for rotational movement, the pivot button including a slot therein extending from a front surface thereof and having a retaining member adjacent a bottom surface thereof; and, a pivot bar attached to the window sash and extending outward horizontally therefrom towards the guide track, the pivot bar including a projection sized to fit into the slot in the pivot button and having a slot therein positioned to engage the retaining member and retain the projection in the slot in the pivot button, the projection being insertable into and removable from the slot only when the window sash is oriented with respect to the window frame in a position not used for vertical sliding movement or for pivoted cleaning of the window sash whereby the pivot bar an the pivot button are non-releasably connected together during normal shipment, installation and use of a window sash and frame employing the window pivot.

In the preferred embodiment, the sliding member has a slot in the front surface thereof communicating between an edge thereof and the bore in the sliding member whereby by rotating the pivot button to place the slot in the pivot button in communication with the slot in the sliding member the projection can be inserted into the slot in the pivot button from the side without interference from the retaining member which is a ridge formed in the bottom surface of the slot in the pivot button.

Further in the preferred embodiment, the sliding member includes a passageway communicating between a side edge thereof and the bore therein; the pivot button has a flattened camming surface on a portion of the periphery thereof aligned with the passageway; and, there is a brake button slidably disposed within the passageway of a length so that when the flattened camming surface is adjacent the brake button the brake button allows the sliding member to slide freely within the guide track and when the flattened camming surface is not adjacent the brake button the brake button is forced outward by the surface of the pivot button to wedge the sliding member within the guide track and prevent sliding thereof.

DESCRIPTION OF THE DRAWINGS

FIG. 1 is a simplified drawing of a window of the type wherein the present invention is employed.

FIG. 2 is a simplified cutaway drawing through the stile and adjacent sash guide of a window frame according to one example of the prior art.

FIG. 3 is a simplified cutaway drawing through the stile and adjacent sash guide of a window frame according to a second example of the prior art.

FIG. 4 is a modification of the drawing of FIG. 3 showing a problem associated with the prior art window pivot of FIG. 3.

FIG. 5 is a simplified drawing showing the common solution to the problem of FIG. 4.

DESCRIPTION OF THE PREFERRED EMBODIMENT

Figure 6:
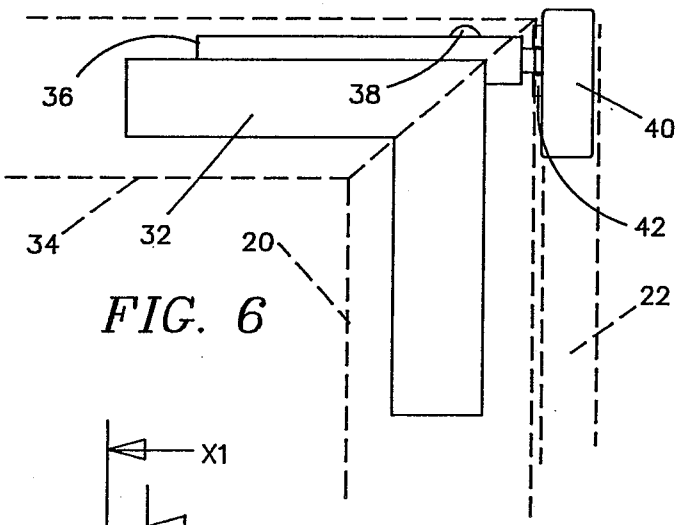
FIG. 6 is a simplified drawing showing how the pivot of the present invention is mounted in a the plastic frame of a window sash.
Figure 7:
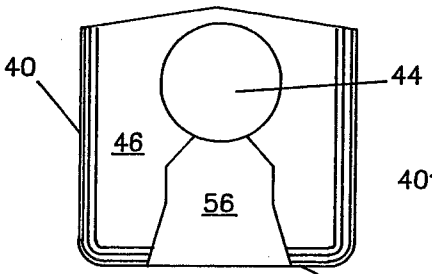
FIG. 7 is a front view of the sliding member of the present invention.
Figure 8:
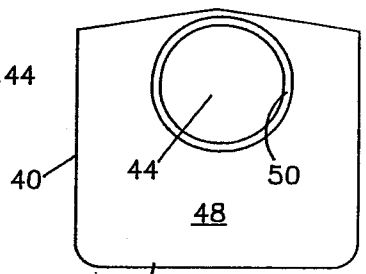
FIG. 8 is a back view of the sliding member of the present invention.
Figure 11:
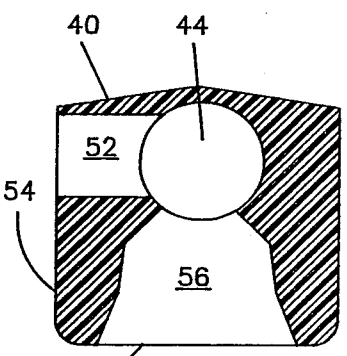
FIG. 11 is a cutaway view of the sliding member of the present invention in the plane XI—XI of FIG. 9.
Figure 10:
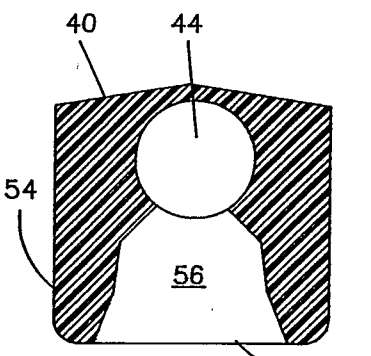
FIG. 10 is a cutaway view of the sliding member of the present invention in the plane X—X of FIG. 9.
Figure 9:
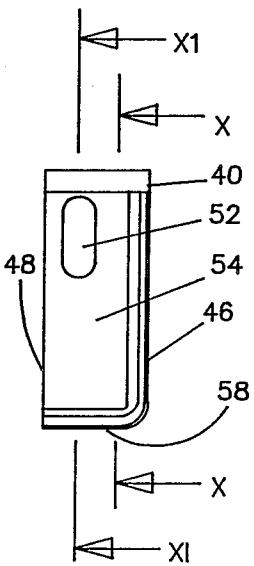
FIG. 9 is a left side view of the sliding member of the present invention.

The preferred manner of mounting the pivot of the present invention is shown in simplified form in FIG. 6. A plastic corner angle 32 is employed to join the side frame 20 to the cross frame generally in a manner known and employed in the art for assembling plastic extrusions comprising window sash. A metal pivot bar 36 is attached to the angle 32 as with screw 38 to project outward sideways from the side frame 20. A sliding member 40 is captive within the guide track 22 in the manner of the prior art of FIG. 3. A pivot button 42 is pivotally carried within the sliding member 40 and lockingly receives the end of the pivot bar 36 therein in a manner to be described in detail shortly. Rotation of the pivot bar 36 rotates the pivot button 42 to activate a locking brake incorporated into the sliding member. The foregoing elements will now be described in detail.

The sliding member is shown in FIGS. 7–11 and generally comprises a rectangular block of plastic having a bore 44 therethrough between the front and back surfaces 46 and 48, respectively. The back surface 48 has a recessed groove 50 about the periphery of the bore 44 for purposes to be addressed shortly. A second bore 52 communicates between a side 54 of the sliding member 40 which slides along the sidewalls of the guide track 22 and the bore 44. The front surface 46 has a slot 56 therein communicating between the bottom 58 and the bore 44.

Figure 16:
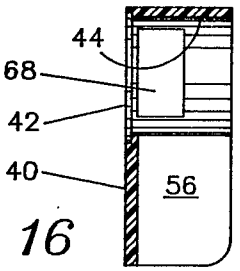
FIG. 16 is a cutaway side view through the center of member with the pivot button mounted therein.
Figure 15:
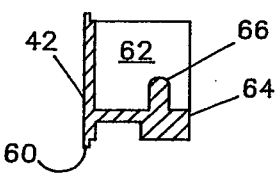
FIG. 15 is a cutaway side view through the center of the pivot button of the present invention.
Figure 14:
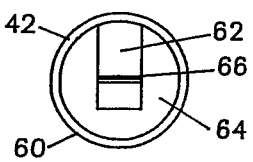
FIG. 14 is a front view of the pivot button of the present invention.
Figure 13:
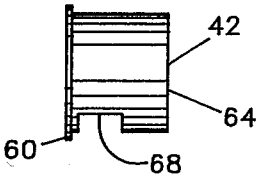
FIG. 13 is a left side view of the pivot button of the present invention.
Figure 12:
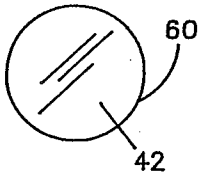
FIG. 12 is a back view of the pivot button of the present invention.

The construction of the pivot button 42 is shown in detail in FIGS. 12–15. The length and diameter of the pivot button 42 is substantially the same as that of the bore 44 so that the button 42 will fit and rotate within the bore 44. The button 42 has a retaining rim 60 about the periphery of the back surface thereof which fits into the groove 50 when the button is pushed into the bore 44 as shown in FIG. 16. This retains the smooth back surface 48 of the sliding member 40 for ease of sliding within the guide track 22. As best seen in FIGS. 14 and 15, there is a rectangular slot 62 in the side of the button 42 communicating with the front surface 64. Slot 62 contains a transverse retaining ridge 66 in the bottom thereof. A flattened camming surface 68 is formed in the outer surface of the button 42 180° from the slot 62.

Figure 18:
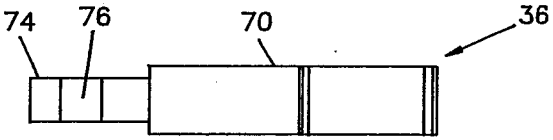
FIG. 18 is a side edge view of the pivot bar of the present invention.
Figure 17:
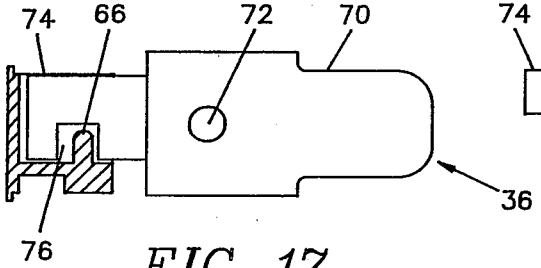
FIG. 17 is a plan view of the pivot bar of the present invention.

The pivot bar 36 is shown in FIGS. 17 and 18. As can be seen therein, the pivot bar 36 comprises a mounting portion 70 for attachment to the sash frame as with a screw through bore 72 from which a pivot arm 74 extends. In the preferred embodiment the pivot bar 36 is a unitary metal casting. As depicted in FIG. 17, the pivot arm 74 is rectangular in shape and is sized to fit totally within the width and vertical depth of the slot 62 so as to be rotatable in combination with the button 42. As also shown in FIG. 17, the pivot arm 74 has a slot 76 in the edge thereof sized and positioned to mate with the retaining ridge 66 when the pivot arm 74 is disposed within the slot 76.

Figure 20:
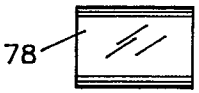
FIG. 20 is a side view of the pivot button of the present invention.
Figure 19:
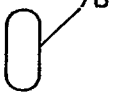
FIG. 19 is an end view of the pivot button of the present invention.

Finally, there is a plastic brake button 78 as shown in FIGS. 19 and 20 which is sized and shaped to slidably fit within the bore 52.

Figure 23:
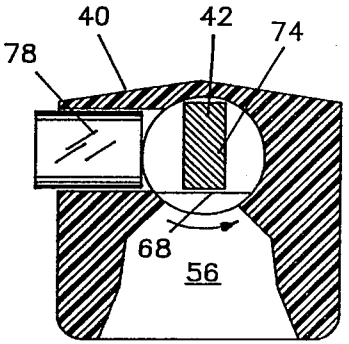
FIG. 23 is a partially cutaway view of the pivot of the present invention in the plane XI—XI of FIG. 9 when positioned to lock a pivoted window sash during washing of the panes thereof.
Figure 22:
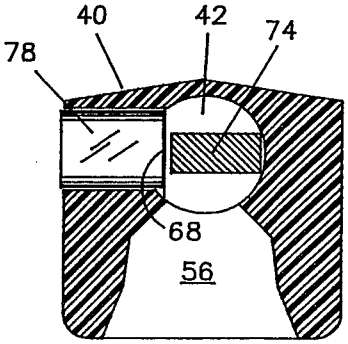
FIG. 22 is a partially cutaway view of the pivot of the present invention in the plane XI—XI of FIG. 9 when positioned to guide a window sash up and down.
Figure 21:
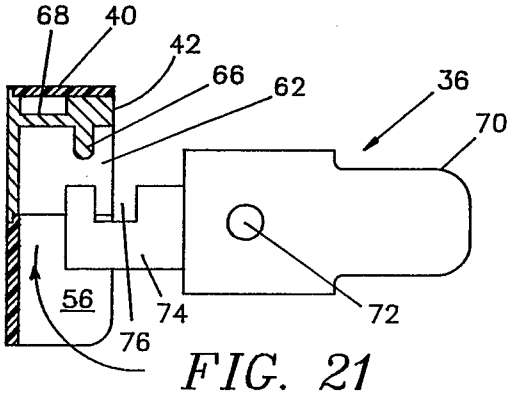
FIG. 21 is a cutaway sideview of the assembled sliding member and pivot button showing the manner of inserting the pivot bar therein.

Assembly and operation of the pivot of the present invention is as shown in FIGS. 21–23. The pivot arm 74 can be inserted into the assembled sliding member 40 and pivot button 42 by rotating the pivot button 42 to place the slot 62 thereof in communication with the slot 56 in the front surface 46 of the sliding member 40 as depicted in FIG. 21. The normal operating position of the pivot is as shown in FIG. 22 wherein the button 42 and pivot arm 74 have been rotated 90° counter clockwise from the insertion position of FIG. 21. As can be seen, the brake button 78 is disposed over the flattened camming surface 68 so that the window sash is free to slide freely up and down. The slot 76 has the retaining ridge 66 disposed therein and, therefore, the components of the pivot of the present invention are locked together as desired for transportation and assembly without fear of their inadvertently coming apart. For braked pivoting for cleaning, the pivot arm 74 is rotated an additional amount in the counter clockwise direction which results in a configuration such as that depicted in FIG. 23 where the brake button 78 is forced outward by the normal outer surface of the pivot button 42 away from the flattened camming surface 68 to wedge against the inside of the guide track 22. The pivot arm 74, of course, is still held captive by the retaining ridge 66 in slot 76.

As can be appreciated by those skilled in the art from the foregoing description, the pivot of the present invention is no more costly to manufacture and install than the prior art pivot of FIG. 3; but, eliminates the necessity for banding to prevent disassembly during shipment and installation.

Wherefore, having thus described my invention, I claim:

1. A double-hung window pivot for slidably and pivotally mounting a window sash to the side member of a window frame having a vertical guide track therein comprising:

(a) a sliding member disposed within the guide track for sliding motion, said sliding member having a bore therein perpendicular to a front surface thereof facing a side edge of the window sash;

(b) a pivot button captively held in said bore for rotational movement, said pivot button including a first portion of connecting means having a surface for connecting a bar to said pivot button; and, (c) a pivot bar attached to the window sash and extending outward horizontally therefrom towards the guide track, said pivot bar including a mating second portion of said connecting means having a mating surface to engage said pivot button surface to captively connect said pivot bar to said pivot button when the window sash is oriented for vertical sliding movement with respect to the window frame, said connecting means being connectable and disconnectable only when the window sash is oriented with respect to the window frame in a position not used for vertical sliding movement or for pivoted cleaning of the window sash whereby said pivot bar and said pivot button are non-releasably connected together during normal shipment, installation and use of a window sash and frame employing the window pivot.

2. The double-hung window pivot of claim 1 and additionally comprising:

(a) said sliding member including a passageway communicating between a side edge thereof and said bore therein;

(b) said pivot button having a flattened camming surface on a portion of the periphery thereof aligned with said passageway; and, (c) a brake button slidably disposed within said passageway, said brake button being of a length so that when said flattened camming surface is adjacent said brake button said brake button allows said sliding member to slide freely within the guide track and when said flattened camming surface is not adjacent said brake button said brake button is forced outward by the surface of said pivot button to wedge said sliding member within the guide track and prevent sliding thereof.

3. A double-hung window pivot for slidably and pivotally mounting a window sash to the side member of a window frame having a vertical guide track therein comprising:

(a) a sliding member disposed within the guide track for sliding motion, said sliding member having a bore therein perpendicular to as front surface thereof facing a side edge of the window sash;

(b) a pivot button captively held in said bore for rotational movement, said pivot button including a first portion of connecting means for connecting a bar to said pivot button; and, (c) a pivot bar attached to the window sash and extending outward horizontally therefrom towards the guide track, said pivot bar including a mating second portion of said connecting means for connecting bar to said pivot button, said connecting means being connectable and disconnectable only when the window sash is oriented with respect to the window frame in a position not used for vertical sliding movement or for pivoted cleaning of the window sash whereby said pivot bar and said pivot button are non-releasably connected together during normal shipment, installation and use of a window sash and frame employing the window pivot;

(d) said first portion comprising said pivot button including a slot therein extending from a front surface thereof and having a retaining member adjacent a bottom surface thereof; and, (e) said second portion comprising said pivot bar including a projection sized to fit into said slot in said pivot button and having a slot therein positioned to engage said retaining member and retain said projection in said slot in said pivot button.

4. The double-hung window pivot of claim 3 wherein:

said sliding member has a slot in said front surface thereof communicating between an edge thereof and said bore in said sliding member whereby by rotating said pivot button to place said slot in said pivot button in communication with said slot in said sliding member said projection can be inserted into said slot in said pivot button from the side without interference from said retaining member.

5. The double-hung window pivot of claim 3 wherein:

said retaining member is a ridge formed in said bottom surface of said slot in said pivot button.

6. The double-hung window pivot of claim 3 wherein:

(a) said bore in said sliding member is a bore through said sliding member between said front surface and a back surface thereof, said bore further including a recessed groove about the periphery thereof in said back surface; and, (b) said pivot button has a retaining rim formed about the periphery of a back surface thereof sized to fit into said recessed groove when said pivot button is pushed into said bore from said back surface whereby said pivot button is held captive from being pulled out through said front surface of said sliding member.

7. In a double-hung window employing pivots for slidably and pivotally mounting a window sash to the side members of a window frame thereof wherein the said members have vertical guide tracks therein and the pivots each include a sliding member disposed within the guide track for sliding motion and a pivot bar attached to the window sash and extending outward horizontally therefrom towards the guide track into pivoted engagement with the sliding member, the improvement for preventing separation of the pivot bars from the sliding members during shipment and installation of the window comprising:

(a) a pivot button captively held in the sliding member for rotational movement, said pivot button including a first portion of connecting means having a surface for connecting a bar to said pivot button; and, (b) the pivot bar including a mating second portion of said connecting means having a mating surface to engage said pivot button surface to captively connect said pivot bar to said pivot button when the window sash is oriented for vertical sliding movement with respect to the window frame, said connecting means being connectable and disconnectable only when the window sash is oriented with respect to the window frame in a position not used for vertical sliding movement or for pivoted cleaning of the window sash whereby said pivot bar and said pivot button are non-releasably connected together during normal shipment, installation and use of a window sash and frame employing the window pivot improvement.

8. In a double-hung window employing pivots for slidably and pivotally mounting a window sash to the side members of a window frame thereof wherein the said members have vertical guide tracks therein and the pivots each include a sliding member disposed within the guide track for sliding motion and a pivot bar attached to the window sash and extending outward horizontally therefrom towards the guide track into pivoted engagement with the sliding member, the improvement for preventing separation of the pivot bars from the sliding members during shipment and installation of the window comprising:

(a) a pivot button captively held in the sliding member for rotational movement, said pivot button including a first portion of connecting means for connecting a bar to said pivot button; and, (b) the pivot bar including a mating second portion of said connecting means for connecting the bar to said pivot button, said connecting means being connectable and disconnectable only when the window sash is oriented with respect to the window frame in a position not used for vertical sliding movement or for pivoted cleaning of the window sash whereby said pivot bar and said pivot button are non-releasably connected together during normal shipment, installation and use of a window sash and frame employing the window pivot improvement;

(c) said first portion comprising said pivot button including a slot therein extending from a front surface thereof and having a retaining member adjacent a bottom surface thereof; and, (d) said second portion comprising said pivot bar including a projection sized to fit into said slot in said pivot button and having a slot therein positioned to engage said retaining member and retain said projection in said slot in said pivot button.

9. The improvement to a double-hung window pivot of claim 8 wherein:

said retaining member is a ridge formed in said bottom surface of said slot in said pivot button.

10. The improvement to a double-hung window pivot of claim 8 wherein:

the sliding member has a slot in said front surface thereof communicating between an edge thereof and a bore in the sliding member having said pivot button disposed therein whereby by rotating said pivot button to place said slot in said pivot button in communication with said slot in the sliding member said projection can be inserted into said slot in said pivot button from the side without interference from said retaining member.

11. The improvement to a double-hung window pivot of claim 10 wherein:

(a) said bore in the sliding member is a bore through the sliding member between a front surface and a back surface thereof, said bore further including a recessed groove about the periphery thereof in said back surface; and, (b) said pivot button has a retaining rim formed about the periphery of a back surface thereof sized to fit into said recessed groove when said pivot button is pushed into said bore from said back surface whereby said pivot button is held captive from being pulled out through said front surface of the sliding member.

12. The improvement to a double-hung window pivot of claim 10 and additionally comprising:

(a) the sliding member including a passageway communicating between a side edge thereof and said bore therein;

(b) said pivot button having a flattened camming surface on a portion of the periphery thereof aligned with said passageway; and, (c) a brake button slidably disposed within said passageway, said brake button being of a length so that when said flattened camming surface is adjacent said brake button said brake button allows the sliding member to slide freely within the guide track and when said flattened camming surface is not adjacent said brake button said brake button is forced outward by the surface of said pivot button to wedge the sliding member within the guide track and prevent sliding thereof.

13. A double-hung window pivot for slidably and pivotally mounting a window sash to the side member of a window frame having a vertical guide track therein comprising:

(a) a sliding member disposed within the guide track for sliding motion, said sliding member having a bore therein perpendicular to a front surface thereof facing a side edge of the window sash;

(b) a pivot button captively held in said bore for rotational movement, said pivot button including a slot therein extending from a front surface thereof and having a retaining member adjacent a bottom surface thereof; and, (c) a pivot bar attached to the window sash and extending outward horizontally therefrom towards the guide track, said pivot bar including a projection sized to fit into said slot in said pivot button and having a slot therein positioned to engage said retaining member and retain said projection in said slot in said pivot button, said projection being insertable into and removable from said slot only when the window sash is oriented with respect to the window frame in a position not used for vertical sliding movement or for pivoted cleaning of the window sash whereby said pivot bar and said pivot button are nonreleasably connected together during normal shipment, installation and use of a window sash and frame employing the window pivot.

14. The double-hung window pivot of claim 13 wherein:

said sliding member has a slot in said front surface thereof communicating between an edge thereof and said bore in said sliding member whereby by rotating said pivot button to place said slot in said pivot button in communication with said slot in said sliding member said projection can be inserted into said slot in said pivot button from the side without interference from said retaining member.

15. The double-hung window pivot of claim 13 wherein:

said retaining member is a ridge formed in said bottom surface of said slot in said pivot button.

16. The double-hung window pivot of claim 13 wherein:

(a) said bore in said sliding member is a bore through said sliding member between said front surface and a back surface thereof, said bore further including a recessed groove about the periphery thereof in said back surface; and, (b) said pivot button has a retaining rim formed about the periphery of a back surface thereof sized to fit into said recessed groove when said pivot button is pushed into said bore from said back surface whereby said pivot button is held captive from being pulled out through said front surface of said sliding member.

17. The double-hung window pivot of claim 13 and additionally comprising:

(a) said sliding member including a passageway communicating between a side edge thereof and said bore therein;

(b) said pivot button having a flattened camming surface on a portion of the periphery thereof aligned with said passageway; and, (c) a brake button slidably disposed within said passageway, said brake button being of a length so that when said flattened camming surface is adjacent said brake button said brake button allows said sliding member to slide freely within the guide track and when said flattened camming surface is not adjacent said brake button said brake button is forced outward by the surface of said pivot button to wedge said sliding member within the guide track and prevent sliding thereof.

* * * * *